US005123389A

United States Patent [19]

Togai et al.

[11] Patent Number: 5,123,389

[45] Date of Patent: Jun. 23, 1992

[54] CONTROLLING SYSTEM FOR VEHICLE-CARRIED INTERNAL COMBUSTION ENGINE

[75] Inventors: Kazuhide Togai, Takatsuki; Yoshiaki Danno, Kyoto, both of Japan

[73] Assignee: Mitsubishi Jidosha Kogyo Kabushiki Kaisha, Tokyo, Japan

[21] Appl. No.: 642,339

[22] Filed: Jan. 17, 1991

[30] Foreign Application Priority Data

Jan. 17, 1990 [JP] Japan ..... 2-7529
Nov. 30, 1990 [JP] Japan ..... 2-337592

[51] Int. Cl.[5] ..... F02D 11/10
[52] U.S. Cl. ..... 123/399; 123/336
[58] Field of Search ..... 123/361, 399, 336, 442

[56] References Cited

U.S. PATENT DOCUMENTS 4,735,183 4/1988 Inoue et al. ..... 123/399
5,002,028 3/1991 Arai et al. ..... 123/399

FOREIGN PATENT DOCUMENTS 113531 5/1989 Japan ..... 123/399

*Primary Examiner*—Tony M. Argenbright
*Attorney, Agent, or Firm*—Wegner, Cantor, Mueller & Player

[57] ABSTRACT

A controlling system for a vehicle-carried internal combustion engine which prevents the rotational speed of the engine from rising excessively high even when an accelerator pedal is operated in a condition of a power transmitting system wherein it does not transmit the driving force of the engine from a transmission to a wheel of the vehicle whether the vehicle is in a stopping condition or in a driving condition. Such condition of the power transmitting system is detected by a driving force transmitting condition detector, and when such condition is detected, a controller controls a throttle valve of the engine so that the opening of the throttle valve may not exceed a predetermined throttle opening greater than an idling throttle opening irrespective of an operation amount of the accelerator pedal.

5 Claims, 10 Drawing Sheets

| FIG.10(a) | FIG.10(b) |
|---|---|

CONTROLLING SYSTEM FOR VEHICLE-CARRIED INTERNAL COMBUSTION ENGINE

BACKGROUND OF THE INVENTION

1. Field of the Invention

This invention relates to a controlling system for a vehicle-carried internal combustion engine for a vehicle having a power transmitting system for transmitting driving force from the internal combustion engine to a wheel by way of a transmission, and more particularly to a controlling system for such vehicle-carried internal combustion engine which includes controlling means of the drive-by-wire type which can drive a throttle valve disposed in an intake air path of the internal combustion engine to open or close irrespective of an amount of operation of an artificial operating member such as, for example, an accelerator pedal for operating the vehicle-carried internal combustion engine.

2. Desciption of the Prior Art

An automobile includes a power transmitting system for transmitting driving force or power from an internal combustion engine, which may be hereinafter referred to only as engine, to a wheel by way of a transmission. Normally, when the transmission is at such a gear position at which the driving force of the engine is not transmitted from the transmission to the wheel, that is, at a neutral position (N range), or at a parking position (P range) where the transmission is an automatic transmission, the engine must only maintain its idling speed. It is waste of fuel to open the throttle valve greater than a necessary level to cause upwash of the engine.

In a conventional automobile, however, since the throttle valve and accelerator pedal are interconnected by way of a rope or cable member, if the accelerator pedal is operated when the gear position is within, for example, the N range or P range, then the output power of the engine is increased and the speed of the engine is raised in response to such operation, which will lead to waste of fuel.

An improved engine controlling system is disclosed, for example, in Japanese Patent Laid-Open No. 113531/1989 wherein the engine rotational speed is compulsorily controlled to a level lower than a predetermined low speed such as an idling speed when the select lever of an automatic transmission of the automobile is in a non-driving range while the vehicle is in a stopping condition in order to eliminate such disadvantage of a conventional internal combustion engine as described above.

Such engine controlling system is superior in fuel consumption because the engine speed is not raised, when the select lever of the automatic transmission is in a non-driving range during stopping of the vehicle, even if the accelerator pedal is operated. However, reversely speaking, even if the accelerator pedal is operated, the engine will not respond to such operation at all. Such phenomenon will cause the driver to have an unfamiliar feeling, that is, an uneasy feeling to the controlling system and hence is not preferable.

Further, the engine controlling system is applied only to an automatic transmission and effective only when the vehicle is in a stopping condition. Accordingly, the engine controlling system is narrow in application.

SUMMARY OF THE INVENTION

It is an object of the present invention to provide a controlling system for a vehicle-carried internal combustion engine which prevents the engine rotational speed from rising excessively high even when an artificial operating member such as an accelerator pedal for operating the engine is operated in a condition wherein the driving force of the engine is not transmitted from a manual or automatic transmission to a wheel of the vehicle whether the vehicle is in a stopping condition or in a driving condition.

In order to attain the object, according to the present invention, there is provided a controlling system for a vehicle-carried internal combustion engine of a vehicle which includes a power transmitting system for transmitting driving force from the internal combustion engine to a wheel by way of a transmission and a throttle valve which is disposed in an intake air path of the internal combustion engine is capable of being actuated to open or close irrespective of an operation amount of an artificial operating member provided for operating the internal combustion engine, the controlling system comprising operation amount detecting means for detecting an operation amount of the artificial operating member, driving force transmitting condition detecting means for detecting whether or not the driving force of the internal combustion engine is transmitted from the transmission to the wheel, and controlling means for controlling, when it is detected by the driving force transmitting condition detecting means that the driving force of the internal combustion engine is not transmitted from the transmission to the wheel, the throttle valve so that the throttle opening thereof may not exceed a predetermined throttle opening greater than an idling throttle opening thereof irrespective of an operation amount of the artificial operating member detected by the operation amount detecting means.

With the controlling apparatus for a vehicle carried internal combustion engine, when it is detected by the driving force transmitting condition detecting means that the driving force of the internal combustion engine is not transmitted from the transmission to the wheel, the throttle valve is controlled by the controlling means so that the throttle opening thereof may not exceed the predetermined throttle opening greater than the idling throttle opening thereof irrespective of an operation amount of the artificial operating member detected by the operation amount detecting means.

Preferably, the controlling means is constituted such that it selects, when it is detected by the driving force transmitting condition detecting means that the driving force of the internal combustion engine is not transmitted from the transmission to the wheel, a smaller one of a first throttle opening which is determined from an operation amount of the artificial operating member detected by the operation amount detecting means and a second throttle opening which is determined from an operating condition of the internal combustion engine and is greater than the idling throttle opening and controls the throttle valve so that the throttle opening thereof may be equal to the thus selected throttle opening. Thus, if the artificial operating member is operated when the power transmitting system is in a condition wherein the driving force of the internal combustion engine is not transmitted from the transmission, which may be an automatic transmission or a manually operated transmission, to the wheel whether the vehicle is in a stopping condition or in a driving condition, then the engine rotational speed rises a little but does not exceed a predetermined level. Consequently, the driver will perceive that the engine has responded well to the operation of the artificial operating member and will not have an unfamiliar feeling. Besides, such waste of fuel as in a conventional engine can be prevented, and deterioration of exhaust gas will not be caused.

Preferably, such second throttle opening is set in accordance with a value obtained by correcting a torque which is determined in accordance with a current condition and a permissible condition of the internal combustion engine with at least one of a temperature of the internal combustion engine and an electric load to the internal combustion engine. Thus, an aimed engine torque can be determined accurately. Further, an upper limit and a lower limit may be set for the second throttle opening by setting an upper limit and a lower limit for a torque which is determined in accordance with a current condition and a permissible condition of the internal combustion engine. Thus, an aimed engine torque will not be set to an excessively high level.

Further, the driving force transmitting condition detecting means may be constituted either as gear position detecting means for detecting a gear position of the transmission or as clutch on/off detecting means for detecting an on/off condition of a clutch interposed between the internal combustion engine and the transmission.

The above and other objects, features and advantages of the present invention will become apparent from the following description and the appended claims, taken in conjunction with the accompanying drawings in which like parts are denoted by like reference characters all through the drawings.

DESCRIPTION OF THE PREFERRED EMBODIMENTS

Figure 1A:
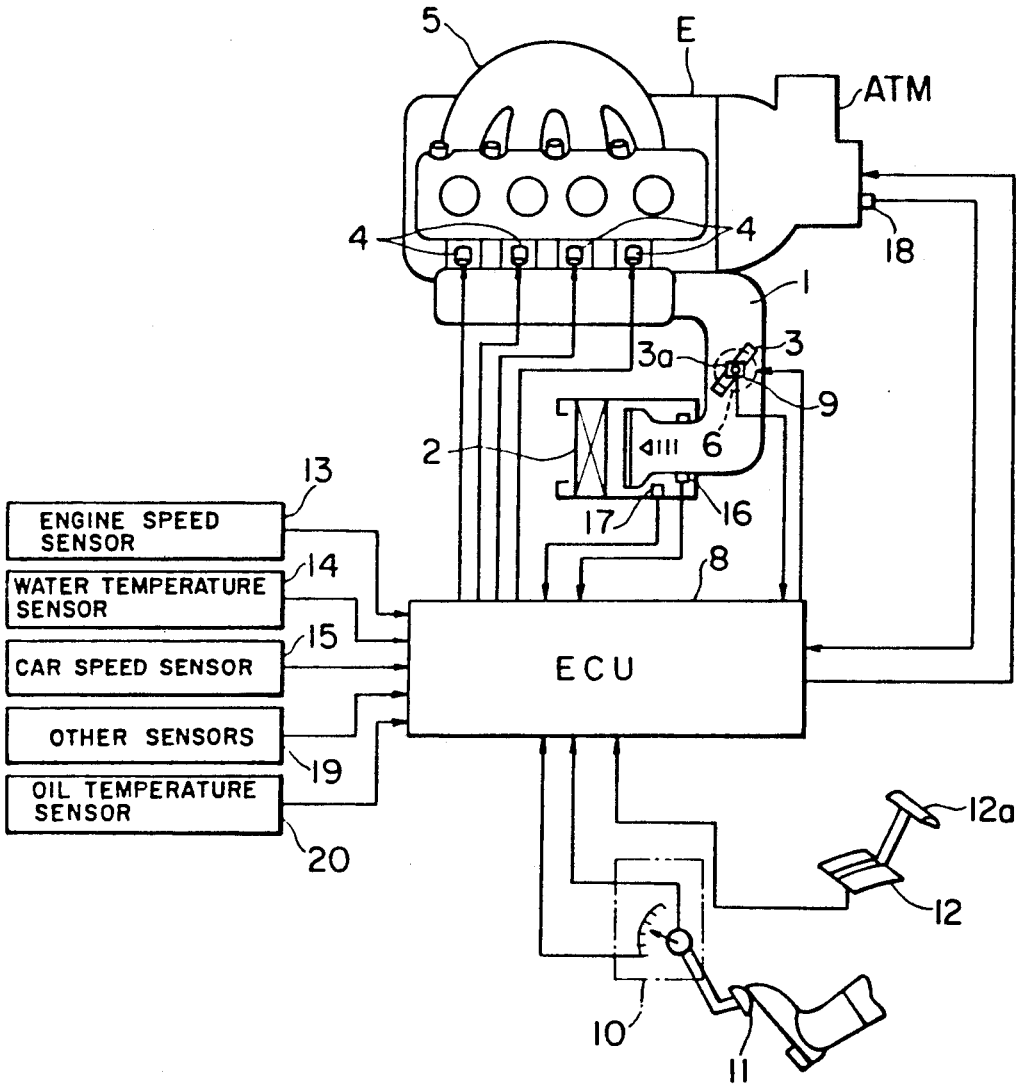
FIG. 1(*a*) is a diagrammatic representation of entire construction of a controlling system for a vehicle-carried internal combustion engine showing a first preferred embodiment of the present invention, and FIG. 1(*b*) is a block diagram of the controlling system of FIG. 1(*a*)
Figure 1B:
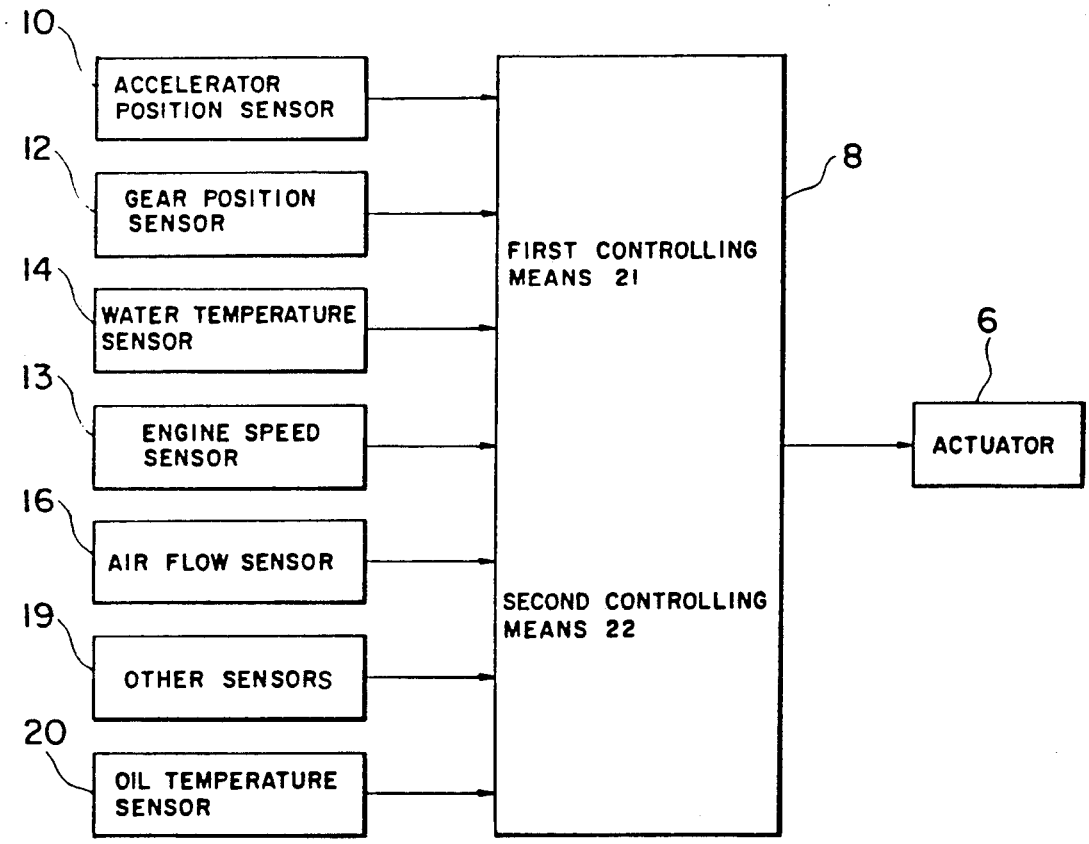

Referring first to FIG. 1(*a*), there is shown entire construction of a controlling system for a vehicle-carried internal combustion engine according to a first preferred embodiment of the present invention. The controlling system shown is incorporated in a gasoline engine E in the form of an internal combustion engine carried on an automobile. The gasoline engine E includes a throttle valve 3 disposed in an intake air path 1 and an electric motor 6 serving as an actuator for driving the throttle valve 3 to open or close. The electric motor 6 may be either a stepper motor or a dc motor and will be hereinafter referred to only as motor. The motor 6 is connected to a throttle shaft 3*a* so that it may drive the throttle valve 3 to open or close by way of the throttle shaft 3*a*.

The motor 6 receives an electric control signal from an electronic controlling unit (ECU) 8 and is controlled in amount of rotation or in number of steps in accordance with the electric control signal. The electronic controlling unit 8 serves as controlling means and includes a microprocessor, memories such as RAM and ROM, input/output interfaces and so forth not shown.

The electronic controlling unit 8 outputs an electric signal for controlling the motor 6 and hence the throttle valve 3 and also outputs a fuel injection controlling signal successively to fuel injection valves (injectors) 4 of the solenoid type provided for intake ports for several cylinders of the engine E. The electronic controlling unit 8 further outputs a controlling signal for the speed changing operation to a solenoid valve (not shown) of a hydraulic controlling section (not shown) of an automatic transmission ATM provided for the engine E. Such controlling signal to the solenoid valve includes a controlling signal for switching a damper clutch or a lockup clutch where such damper clutch or lockup clutch is provided in a torque converter (not shown) interposed between the automatic transmission ATM and the engine E. The electronic controlling unit 8 thus includes a computer section (THC) for controlling the throttle opening, another computer section (ECI) for controlling an amount of fuel injection, and a further computer section (ELC) for controlling speed changing operation of the automatic transmission ATM. The electronic controlling unit 8 further includes an ignition timing controlling computer section.

Referring also to FIG. 1(*b*), the electronic controlling unit 8 is connected to receive detection signals from a throttle position sensor 9, an accelerator position sensor 10, a gear position sensor 12, an engine speed sensor 13, a water temperature sensor 14, a car speed sensor 15, an air flow sensor 16, an intake air temperature sensor 17, transmission information detecting means 18, an oil temperature sensor 20 and some other sensors 19.

The throttle position sensor 9 detects an opening of the throttle valve 3 and may be, for example, a potentiometer.

The accelerator position sensor 10 detects a treadled amount (operation amount) of an accelerator pedal 11 serving as an artificial operating member for operating driving of the engine E and hence of the automobile and constitutes operation amount detecting means.

The gear position sensor 12 detects which one of lever positions P, R, N, D, 2 and L is occupied by a selector lever 12*a* for the automatic transmission ATM, and constitutes gear position detecting means or driving force transmitting condition detecting means for detecting a gear (shift) position of the automatic transmission ATM.

The engine speed sensor 13 detects a rotational speed of the engine E from a number of ignition pulses while the water temperature sensor 14 detects a temperature of cooling water of the engine E.

The car speed sensor 15 detects an actual speed of the automobile while the air flow sensor 16 is provided in the proximity of an air cleaner 2 for detecting a Kalman's vortex street in a flow of air to detect an amount of intake air. The intake air temperature sensor 17 detects a temperature of intake air.

The transmission information detecting means 18 detects transmission information such as a rotational speed of an output shaft of the automatic transmission ATM, a rotational speed of a kick down drum or the like.

The oil temperature sensor 20 detects a temperature of oil of the engine E.

The other sensors 19 may include an atmospheric pressure sensor, an $O_2$ sensor disposed in the exhaust air path 5 of the engine E, an acceleration sensor for detecting an acceleration of the vehicle, and so forth.

By the way, if attention is paid to a function of the electronic controlling unit 8 for controlling the throttle opening, then the electronic controlling unit 8 is considered to have first controlling means 21 and second controlling means 22 as seen in FIG. 1(*b*).

Here, the first controlling means 21 controls the throttle opening in accordance with an operation amount of the accelerator pedal 11 while the second controlling means 22 controls, when the gear position is within the N or P range, the throttle opening preferentially to the first controlling means 21 so that the throttle opening may not exceed a predetermined throttle opening greater than an idling throttle opening of the throttle valve 3 irrespective of an operation amount of the accelerator pedal 11. In particular, the second controlling means 22 selects, when the P or N range position of the automatic transmission ATM is detected by the gear position sensor 12, a smaller one of a first throttle opening which is calculated from an accelerator pedal operation amount detected by the accelerator position sensor 10 and a second throttle opening which is calculated from an operating condition of the engine E such as a rotational speed of or a load to the engine E and is greater than the idling throttle opening. Then, the second controlling means 22 controls the throttle valve 3 so that the actual throttle opening may be equal to the thus selected throttle opening.

Several examples of control by the second controlling means 22 will be described subsequently.

A first example will first be described with reference to a flow chart of FIG. 2. In this instance, it is judged first at step A1 whether or not the throttle opening is to be limited, that is, whether the second controlling means 22 should be rendered inoperative or operative. In case the throttle opening should be limited, that is, in case the second controlling means 22 should be rendered operative, the control sequence of the electronic controlling unit 8 follows the YES route and advances to step A2 at which it is judged whether or not the gear position is N or P, that is, whether or not the gear position is such a gear position at which the driving force from the engine E is not transmitted to a wheel of the vehicle by way of the automatic transmission ATM.

If the judgement is in the affirmative, then the control sequence follows the YES route of the step A2 and advances to step A3 at which a throttle opening $\theta a$ is determined from an accelerator position either using a memory map or memory table or by calculation. It is to be noted that the relationship between the accelerator position and the throttle opening $\theta a$ is such, for example, as shown by a characteristic graph in the block of the step A3.

Then at step A4, a permissible throttle opening $\theta p$ which depends upon a water temperature, a condition of an air conditioner not shown, an electric load and so forth is determined either using a memory map or memory table or by calculation.

Subsequently at step A5, a smaller one of the throttle opening $\theta a$ and the permissible throttle opening $\theta p$ is determined as an aimed throttle opening $\theta t$.

It is to be noted that, in case the judgment at step A1 or A2 is in the negative (NO), the control sequence comes to an end without rendering the second controlling means 22 operative.

Subsequently, a second example of control will be described with reference to a flow chart of FIG. 3. In this instance, it is first judged at step B1 whether or not the throttle opening is to be limited, that is, whether the second controlling means 22 should be rendered inoperative or operative. In case the throttle opening should be limited, that is, in case the second controlling means 22 should be rendered operative, the control sequence follows the YES route and advances to step B2 at which it is judged whether or not the gear position is N or P, that is, whether or not the gear position is such a gear position at which the driving force from the engine E is not transmitted to the wheel by way of the automatic transmission ATM.

If the judgment is in the affirmative, then the control sequence follows the YES route of the step B2 and advances to step B3 at which a throttle opening $\theta a$ is determined from an accelerator position either using a memory map or memory table or by calculation. It is to be noted that the relationship between the accelerator position and the throttle opening $\theta a$ is such, for example, as shown by a characteristic graph in the block of the step B3.

Then at step B4, a permissible engine rotational speed Np is determined in connection with a relationship to a temperature of engine cooling water. Such permissible engine rotational speed Np has a value higher than an ordinary idling rotational speed of the engine E. Subsequently at step B5, a basic torque Ta for the permissible engine rotational speed Np is determined. Then at step B6, a current output torque Teo is estimated from an intake air amount A/N for one rotation of the engine E and an engine rotational speed Ne, and then at step B7, the estimated torque Teo is corrected with the temperature of engine cooling water. After then, at step B8, an aimed engine torque Tt is determined in accordance with the following expression:

$$Tt = Ta + Kt(Ta - Te) + Kn(Np - Ne)$$

where Kt and Kn are gains.

After the aimed engine torque Tt is determined in this manner, a permissible throttle opening $\theta p$ is determined, at step B9, from the aimed engine torque Tt and an engine rotational speed Ne, and then at step B10, a smaller one of the throttle opening $\theta a$ and the permissible throttle opening $\theta p$ is selectively determined as an aimed throttle opening $\theta t$.

It is to be noted that, in case the judgment at step B1 or B2 is in the negative, the control sequence comes to an end without rendering the second controlling means 22 operative.

Subsequently, a third example of control will be described with reference to a flow chart of FIG. 4. In this instance, it is first judged at step C1 whether or not the throttle opening is to be limited, that is, whether the second controlling means 22 should be rendered inoperative or operative. In case the throttle opening should be limited, that is, in case the second controlling means 22 should be rendered operative, the control sequence follows the YES route and advances to step C2 at which it is judged whether or not the gear position is N or P, that is, whether or not the gear position is such a gear position at which the driving force from the engine E is not transmitted to the wheel by way of the automatic transmission ATM.

If the judgment is in the affirmative, then the control sequence follows the YES route of the step C2 and advances to step C3 at which a throttle opening $\theta a$ is determined from an accelerator position either using a memory map or memory table or by calculation. It is to be noted that the relationship between the accelerator position and the throttle opening $\theta a$ is such, for example, as shown by a characteristic graph in the block of the step C3.

Figure 5:
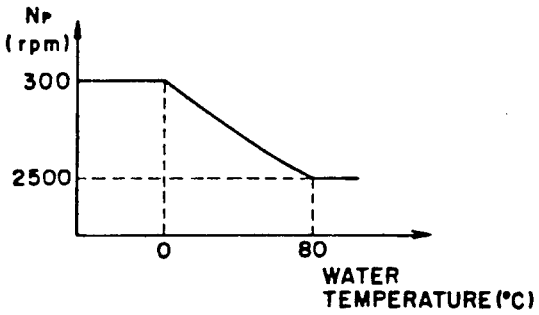
FIGS. 5 to 8 are diagrams illustrating operation of the controlling system of FIG. 1(*a*)

Then at step C4, a permissible engine rotational speed Np which normally has a value higher than an idling rotational speed of the engine E is determined from a relationship $f_1$ to a temperature of engine cooling water. The relationship $f_1$ then is such, for example, as indicated by a curve in FIG. 5.

Subsequently at step C5, an acceleration torque Tao is calculated by multiplying a difference between the permissible rotational speed Np and a current engine rotational speed Ne by a predetermined conversion gain K. Then at step C6, upper and lower limit values are set for the thus calculated acceleration torque Tao.

Figure 6:
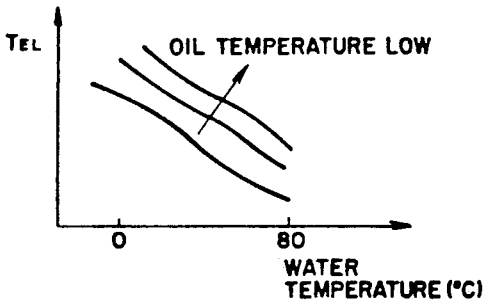
Figure 7:
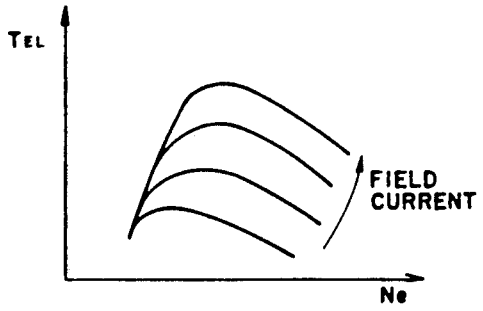

Further at step C7, a torque loss $T_{ML}$ is estimated from a relationship $f_2$ to an engine water temperature and an engine oil temperature, and at next step C8, an electric load torque $T_{EL}$ is estimated from a relationship $f_3$ to an engine rotational speed or a field current (generating current) of an alternator. The relationships $f_2$ and $f_3$ then are such, for example, as indicated by curves in FIGS. 6 and 7, respectively.

After then, the acceleration torque Ta obtained by the limiting processing at step C6, the torque loss $T_{ML}$ and the electric load torque $T_{EL}$ are added to each other to obtain an aimed engine torque Tt at step C9.

Figure 8:
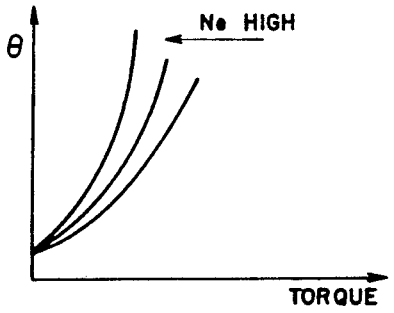

After the aimed engine torque Tt is calculated in this manner, a permissible throttle opening $\theta p$ is determined, at step C10, from such relationship $f_5$ as indicated by curves in FIG. 8 from the aimed engine torque Tt. Accordingly, a permissible throttle opening $\theta p$ is set by correcting a torque (acceleration torque) which is determined from a current rotational condition and a permissible rotational condition of the engine E in accordance with at least one of an internal combustion engine temperature (a water temperature or an oil temperature) and an electric load to the engine E.

Then at step C11, a smaller one of the throttle opening $\theta a$ and the permissible throttle opening $\theta p$ is determined as an aimed throttle opening $\theta t$.

It is to be noted that, in case the judgment at step C1 or C2 is in the negative, the control sequence comes to an end without rendering the second controlling means 22 operative.

Figure 4:
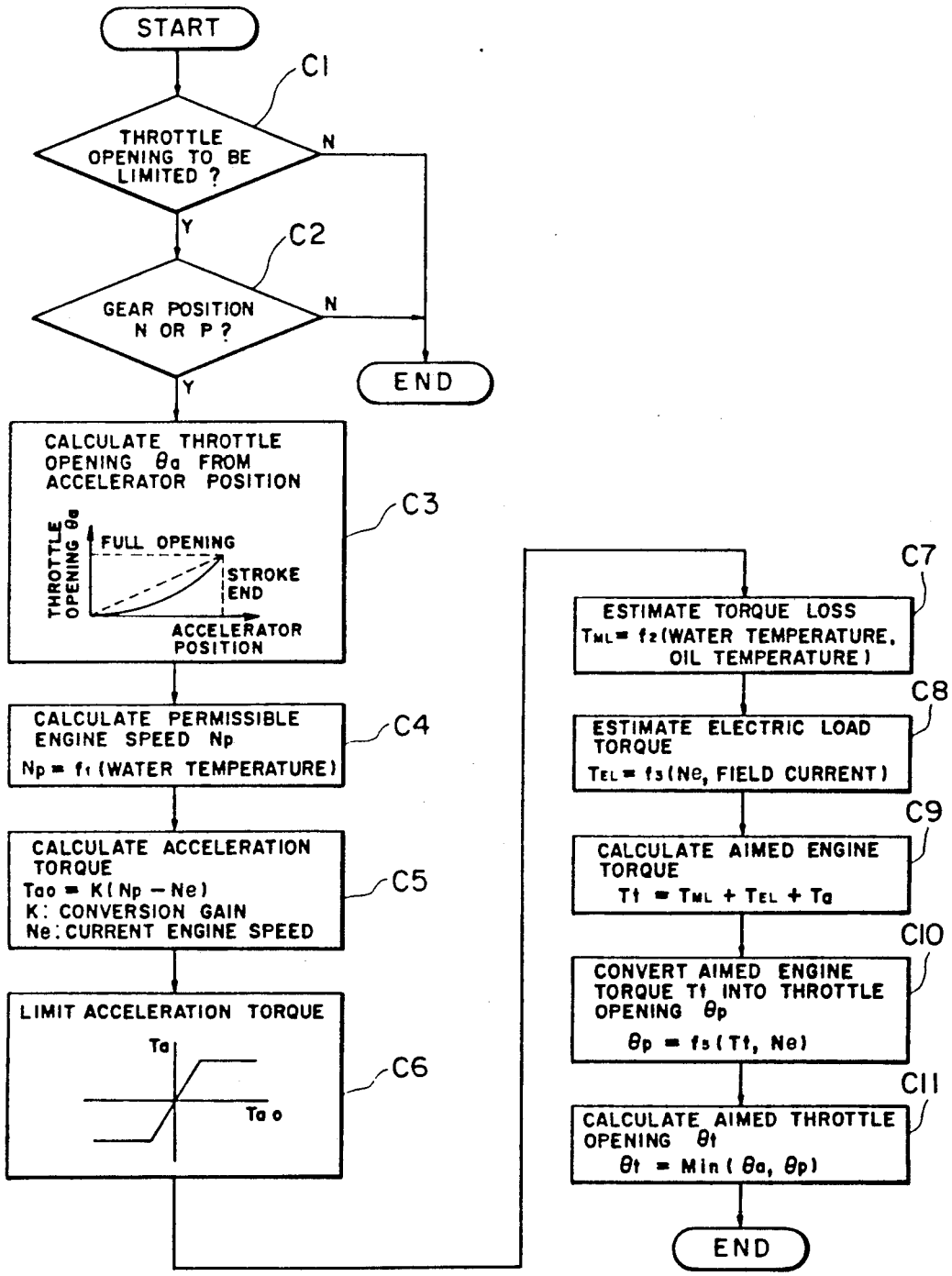

It is to be further noted that the technique illustrated in FIG. 4 may be modified such that an engine torque is converted first into an intake air amount A/N for one rotation of the engine E and then into a throttle opening.

Figure 2:
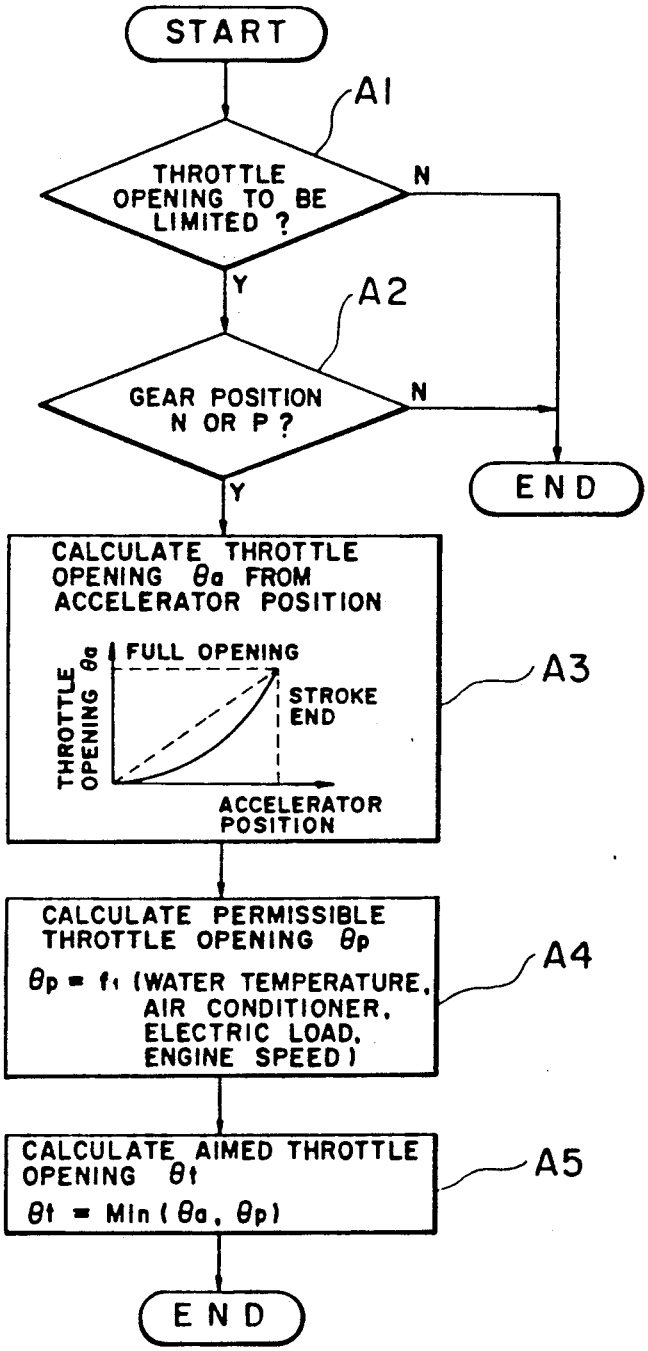
FIGS. 2 to 4 are flow charts illustrating different examples of operation of the controlling system FIG. 1(*a*)
Figure 3:
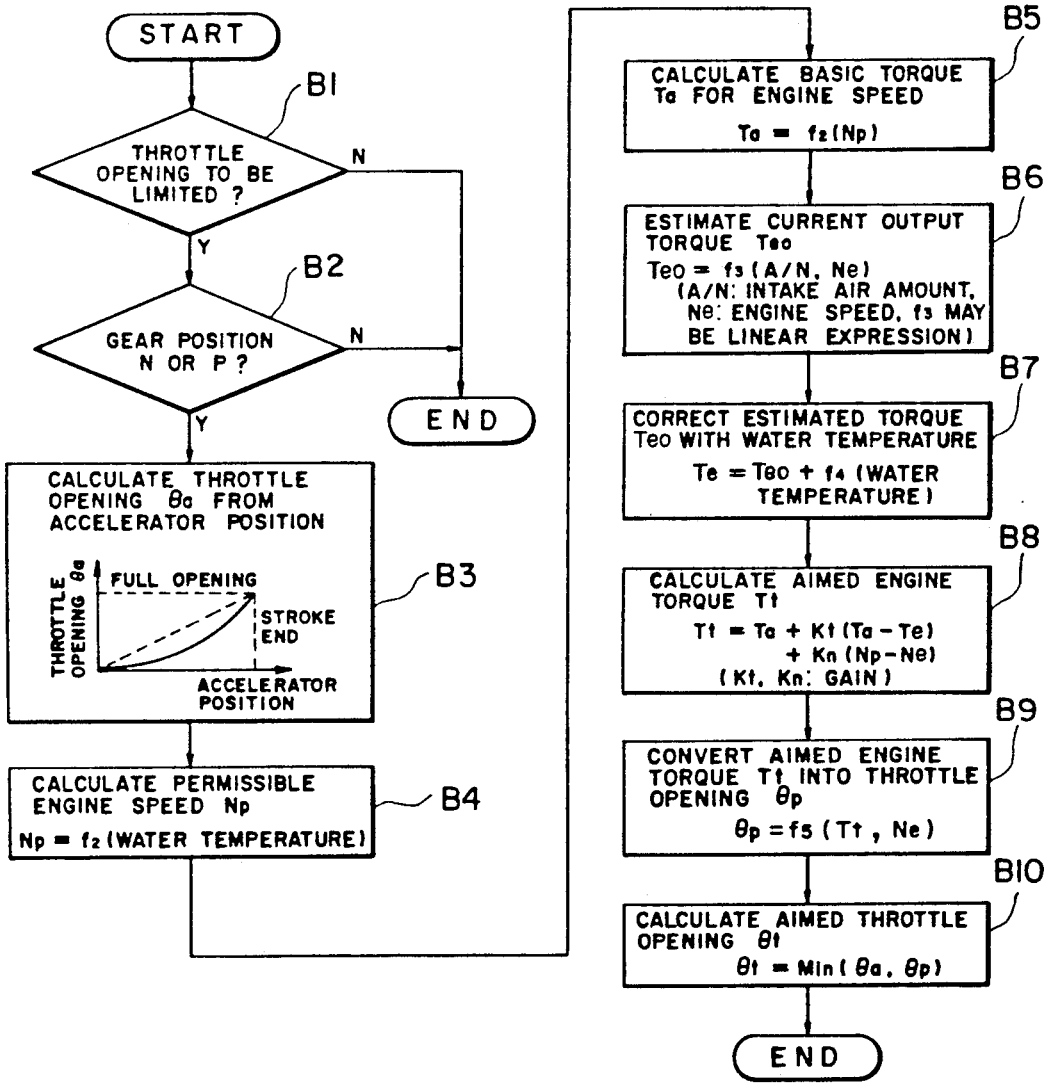

Whicheve one of the techniques illustrated in FIGS. 2 to 4 is employed, when the N or P range position of the automatic transmission ATM is detected by the gear position sensor 12, the throttle valve 3 is controlled so that an aimed throttle opening $\theta t$ may not be exceeded irrespective of an operation amount of the accelerator pedal 11 detected by the accelerator position sensor 10. As a result, if the accelerator pedal 11 is operated when the gear position is either within the N range whether the vehicle is in a stopping condition or in a driving condition or within the P range, then the engine rotational speed rises a little, that is, beyond the idling rotational speed, but it does not rise higher than a predetermined level but is restricted, for example, to 2,500 rpm or so. Consequently, the driver will perceive that the engine has responded to the operation of the accelerator pedal 11, and accordingly, the driver will not have an unfamiliar feeling. Besides, such waste of fuel as in a conventional engine can be prevented, and deterioration of exhaust gas will not be invited.

It is to be noted that, even if the NO route of the step A2, B2 or C2 of FIG. 2, 3 or 4 is modified such that, when the shift lever 12*a* which has been in the N range or P range till then is shifted into the D range, the control sequence advances to step A3, B3 or C3 to subsequently execute the throttle control for causing the engine E to produce output power corresponding to an operation amount of the accelerator pedal 11, the engine E will not respond quickly due to a delay in time. Consequently, even if the shift lever 12*a* is shifted from the N range or P range to the D range in an operated condition of the accelerator pedal 11, possible occurrence of a rapidly accelerated condition of the vehicle is prevented. Accordingly, the driving comfort will not be deteriorated.

Figure 9:
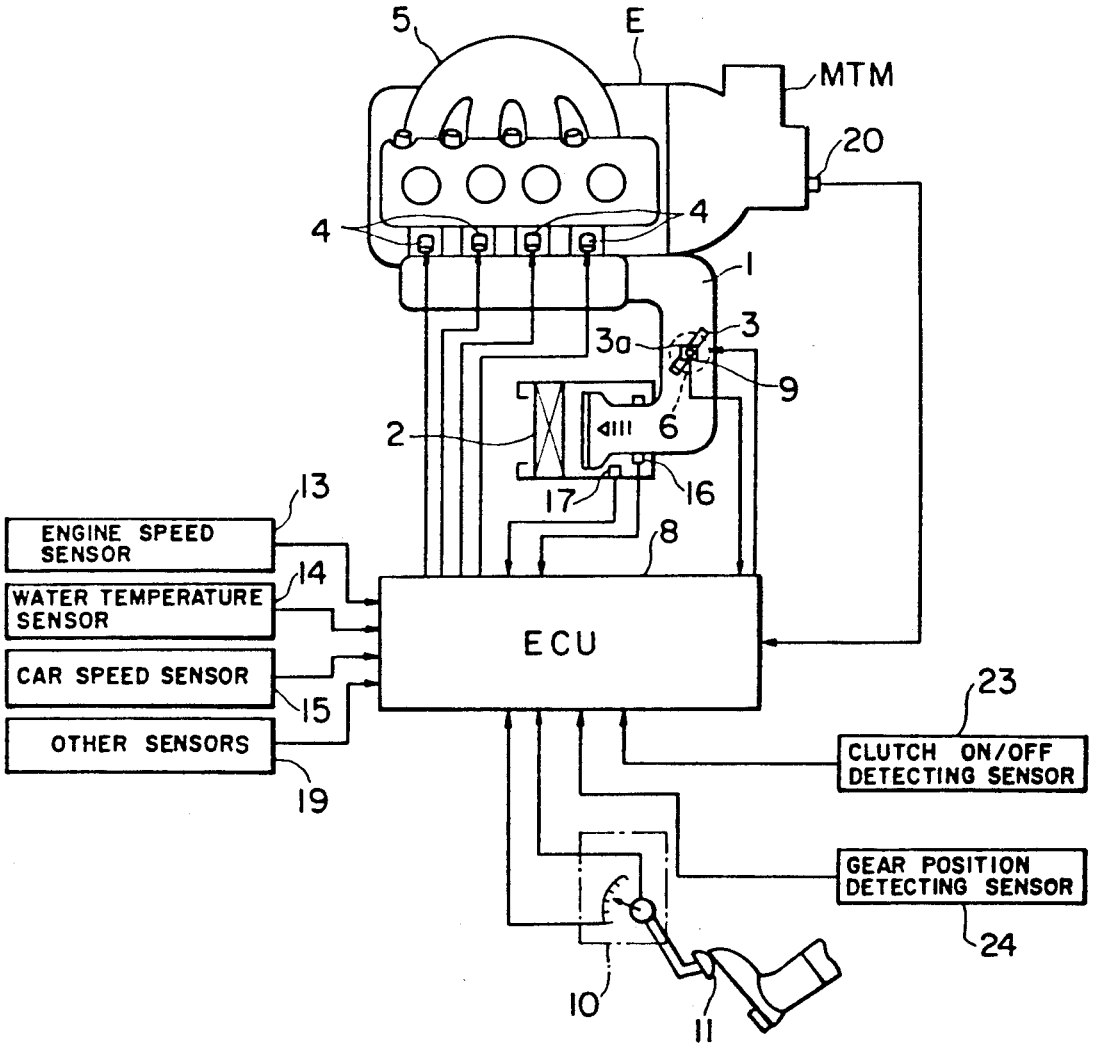
FIG. 9 is a diagrammatic representation of entire construction of another controlling system for a vehicle-carried internal combustion engine showing a second preferred embodiment of the present invention.

Subsequently, a controlling system for a vehicle-carried internal combustion engine according to a second preferred embodiment of the present invention will be described with reference to FIG. 9. The controlling system is a modification to the controlling system of the first embodiment described above in that, while the controlling system is incorporated in a drive-by-wire car as seen in FIG. 9, the transmission employed therein is not such automatic transmission ATM as described above but is a manually operated transmission MTM.

Since the manual transmission MTM is employed in this manner, a clutch (not shown) which is operated by operation of a clutch pedal not shown is interposed between the engine E and the manual transmission MTM. Thus, the controlling system includes a clutch on/off detecting sensor (clutch on/off detecting means) 23 for detecting an on/off condition of the clutch. The controlling system further includes a gear position detecting sensor 24 for detecting a gear position of the transmission MTM.

Accordingly, the clutch on/off detecting sensor 23 and/or the gear position detecting sensor 24 constitute driving force transmitting condition detecting means for detecting whether or not the driving force transmitting system is in a condition wherein the driving force from the engine E is transmitted from the transmission MTM to the wheel.

Detection signals of the clutch on/off detecting sensor 23 and gear position detecting sensor 24 are inputted to the electronic controlling unit 8 together with detection signals of the other sensors 11, 13 to 20.

Subsequently, if attention is paid to a function of the electronic controlling unit 8 for controlling the throttle opening of the throttle valve 3, then the electronic controlling unit 8 is considered to have first controlling means 21 and second controlling means 22 (refer to FIG. 1(*b*)) similarly as in the first embodiment described hereinabove.

Here, the first controlling means 21 controls the throttle opening in accordance with an operation amount of the accelerator pedal 11 while the second controlling means 22 controls, when the clutch is in an off (disengaged) condition or the gear position is within the N range, the throttle opening preferentially to the first controlling means 21 so that the throttle opening may not exceed a throttle opening which is set as an opening greater than an idling throttle opening of the throttle valve 3 irrespective of an operation amount of the accelerator pedal 11.

Figures 10, 10A:
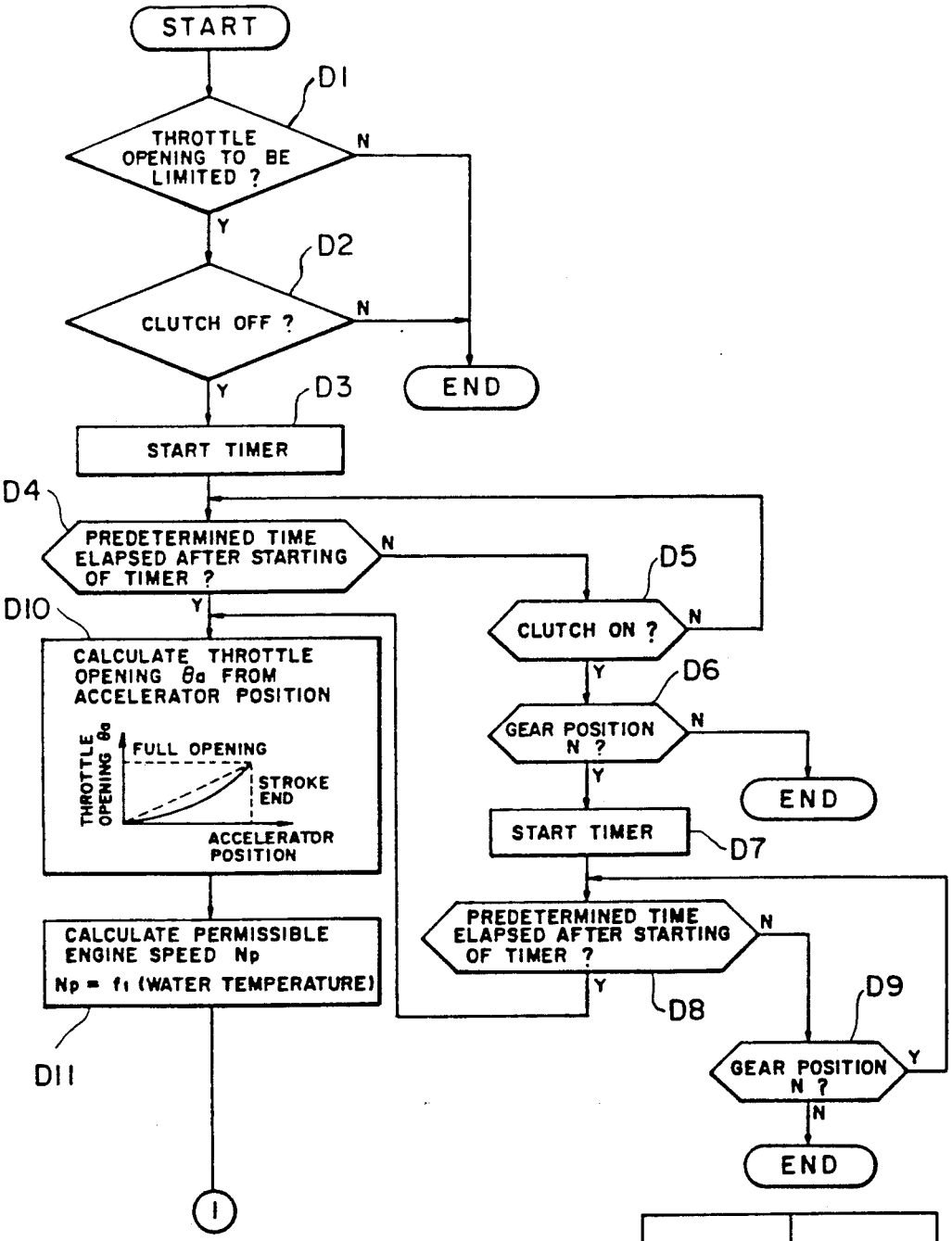
FIGS. 10, 10(*a*) and 10(*b*) are, in combination, a flow chart illustrating operation of the controlling system of FIG. 9.
Figure 10B:
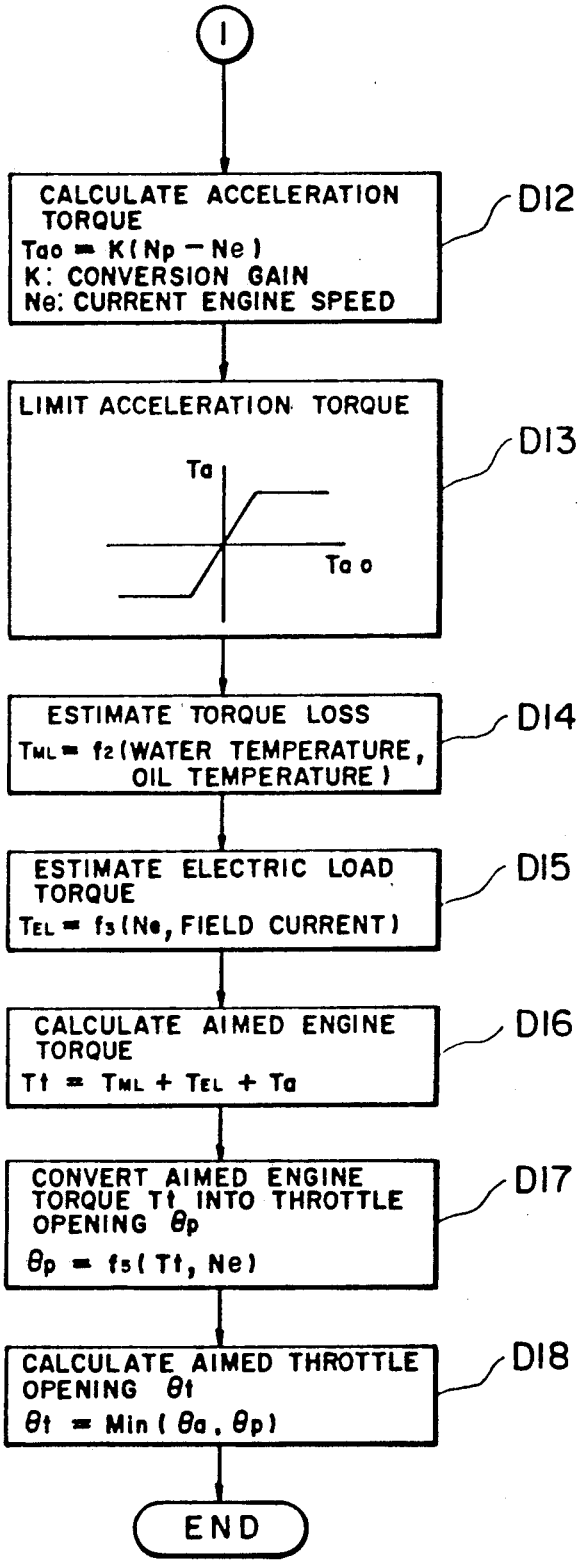

A manner of control by the second controlling means 22 will be described subsequently with reference to a flow chart of FIGS. 10(*a*) and 10(*b*). First, it is judged at step D1 whether or not the throttle opening is to be limited, that is, whether the second controlling means 22 should be rendered inoperative or operative. In case the throttle opening should be limited, that is, in case the second controlling means 22 should be rendered operative, the control sequence follows the YES route and advances to step D2 at which it is judged whether or not the clutch is in an off (disengaged) condition wherein the driving force from the engine E is not transmitted to the wheel by way of the transmission MTM.

If the judgement is in the affirmative, then the control sequence follows the YES route of the step D2 and advances to step D3 at which a timer is started and then to step D4 at which it is judged whether or not a predetermined interval of time has elapsed after starting of the timer. If the predetermined interval of time has not elapsed yet at step D4, then it is judged at step D5 whether the clutch is in an on (engaged) condition. If the clutch is in an off (disengaged) condition then, then the control sequence returns to step D4. But on the contrary if the clutch is in an on (engaged) condition then, then the control sequence advances to step D6 at which it is judged whether or not the gear position is N. If the judgment is in the affirmative, then the timer is started at step D7, and it is judged at step D8 whether or not another predetermined interval of time has elapsed after starting of the timer. If the predetermined interval of time has not elapsed yet at step D8, then it is judged at step D9 whether or not the gear position is N, and then if the gear position is N, the control sequence returns to step D8. Then, if the predetermined interval of time has elapsed at step D8, processing at step D10 is executed subsequently. It is to be noted that, also in case the predetermined interval of time has elapsed at step D4, the control sequence advances to step D10.

By execution of such processing as described above, it can be discriminated whether or not the clutch has been kept in an off condition for the predetermined interval of time or the clutch has been temporarily kept in an off condition for a gear shifting operation as well as whether or not the gear position is left at the N position or the gear position has passed the N position during a gear shifting operation. Here, the YES route of the step D4 or D8 is followed in case the clutch has been kept in an off condition for the predetermined interval of time or the gear position has been kept at the N position for the predetermined interval of time.

Then at step D10, a throttle opening $\theta a$ is determined from an accelerator position either using a memory map or memory table or by calculation. It is to be noted that the relationship between the accelerator position and the throttle opening $\theta a$ is such, for example, as shown by a characteristic graph in the block of the step D10.

Further at step D11, a permissible engine rotational speed Np which normally has a value higher than an idling rotational speed of the engine E is determined from a relationship $f_1$ to a temperature of engine cooling water. The relationship $f_1$ then is such, for example, as indicated by the curve in FIG. 5.

Then at subsequent step D12, an acceleration torque Tao is calculated by multiplying a difference between the permissible engine rotational speed Np and a current engine rotational speed Ne by a predetermined conversion gain K. Then at step D13, upper and lower limit values are set for the thus calculated acceleration torque Tao.

Further at step D14, a torque loss $T_{ML}$ is calculated from a relationship $f_2$ to an engine water temperature and an engine oil temperature, and at next step D15, an electric load torque $T_{EL}$ is estimated from a relationship $f_3$ to an engine rotational speed or a field current (generating current) of an alternator. The relationships $f_2$ and $f_3$ then are such, for example, as indicated by the curves in FIGS. 6 and 7, respectively, similarly as in the preceding embodiment described hereinabove.

After then, the acceleration torque Ta obtained by the limiting processing at step D13, the torque loss $T_{ML}$ and the electric load torque $T_{EL}$ are added to each other to obtain an aimed engine torque Tt at step D16.

After the aimed engine torque Tt is calculated in this manner, a permissible throttle opening $\theta p$ is determined, at step D17, from such relationship $f_5$ as indicated by the curves in FIG. 8 from the aimed engine torque Tt. Accordingly, a permissible throttle opening $\theta p$ is set by correcting a torque (acceleration torque) which is determined from a current rotational condition and a permissible rotational condition of the engine E with at least one of an internal combustion engine temperature (a water temperature or an oil temperature) and an electric load to the engine E.

Then, at step D18, a smaller one of the throttle opening $\theta a$ and the permissible throttle opening $\theta p$ is determined as an aimed throttle opening $\theta t$.

It is to be noted that, in case the judgment at step D1, D2, D6 or D9 is in the negative (NO), the control sequence comes to an end without rendering the second controlling means 22 operative.

Also in the case of the present embodiment, processing similar to that of FIG. 2 or 3 in the first embodiment described hereinabove may otherwise be executed.

In this manner, after an off condition of the clutch or the N position is detected, the throttle valve 3 is controlled so that the throttle opening thereof may not exceed the aimed throttle opening $\theta t$ irrespective of an operation amount of the accelerator pedal 11 detected by the accelerator position sensor 10. As a result, whether the vehicle is in a stopping condition or in a driving condition, if the accelerator pedal 11 is operated when the clutch is in an off condition or the gear position is the N position, the engine rotational speed rises a little to a level higher than the idling rotational speed, but the engine rotational speed does not become excessively high and is restricted, for example, to 2,500 rpm or so. Consequently, the driver will perceive that the engine has responded to the operation of the accelerator pedal 11. Besides, such waste of fuel as in a conventional engine can be prevented, and deterioration of exhaust gas will not be caused.

It is to be noted that, even if the clutch is changed over from an off condition to an on condition or the transmission MTM is shifted to any other gear position than the N position and consequently the engine E is put into a condition in which it produces an output power corresponding to the operation amount of the accelerator pedal 11, the engine E will not respond quickly due to a delay in time. Consequently, possible occurrence of a rapidly accelerated condition of the vehicle is prevented, and accordingly, the driving comfort will not be deteriorated.

Figure 11:
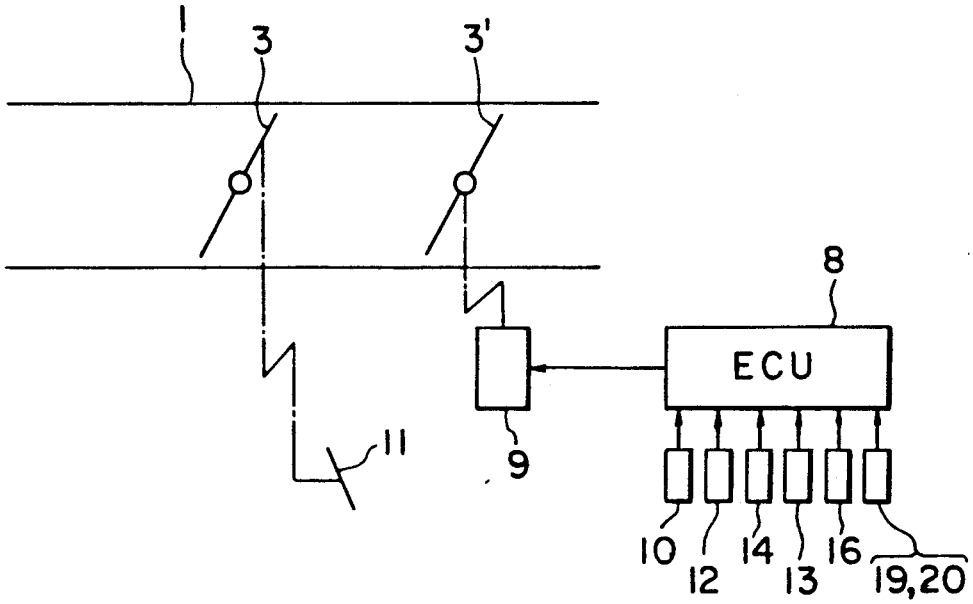
FIG. 11 is a diagrammatic representation of part of a further controlling system for a vehicle-carried internal combustion engine showing a third preferred embodiment of the present invention.

By the way, the present invention can be applied to such a controlling system as shown in FIG. 11 wherein two throttle valves 3 and 3' are disposed in series in an intake air path 1 and the throttle valve 3 on the downstream side is connected to an accelerator pedal 11 by way of a rope or cable member such that it may be driven to open or close in response to the accelerator pedal 11 while the other throttle valve 3' on the upstream side is driven to open or close by means of an actuator 9 such as a stepper motor or a dc motor.

In particular, when the gear position is within the N or P range (or when an off condition of a clutch continues or the gear position is the N position), the throttle opening of the throttle valve 3' is controlled so that it may not exceed a predetermined throttle opening greater than an idling throttle opening irrespective of an operation amount of the accelerator pedal 11. Then, such control is executed by the technique illustrated in FIGS. 2, 3, 4 or 10 similarly as in the case of the controlling system which includes a single throttle valve described hereinabove.

In this manner, also with the controlling system shown in FIG. 11, when it is detected that the gear position is within the N or P range (or that an off condition of the clutch continues or the gear position is the N position), the throttle valve 3' is controlled so that the throttle opening thereof may not exceed an aimed throttle opening $\theta t$ irrespective of an operation amount of the accelerator pedal 11 detected by the accelerator position sensor 10. In this instance, even if the throttle valve 3 is opened to a great degree by operation of the accelerator pedal 11, because the throttle vale 3' is not opened greater than the predetermined amount, the intake air amount relies upon the throttle valve 3' of the smaller opening. As a result, even if the accelerator pedal 11 is operated when the gear position is within the N or P range (or when an off condition of the clutch continues or the gear position is the N position), the engine rotational speed rises a little to a level higher than the idling rotational speed, but the engine rotational speed does not become excessively high and is restricted, for example, to 2,500 rpm or so. Consequently, the driver will perceive that the engine has responded to the operation of the accelerator pedal 11 similarly as in the case of the controlling system which includes a single throttle valve described hereinabove. Besides, such waste of fuel as in a conventional engine can be prevented, and deterioration of exhaust gas will not be invited.

It is to be noted that, even if the shift lever 12*a* of the transmission which has been in the N range or the P range is shifted to the D range or the clutch is changed over from an off condition to an on condition or else the transmission is shifted to any other gear position than the N position and consequently the engine E is put into a condition in which it produces an output power corresponding to the operation amount of the accelerator pedal 11, the engine E will not respond quickly due to a delay in time. Consequently, possible occurence of a rapidly accelerated condition of the vehicle is prevented, and accordingly, the driving comfort will not be deteriorated.

The present invention can also be applied similarly to any other vehicle than an automobile which includes a power transmitting system for transmitting the driving force from an engine to a wheel by way of a transmission.

What is claimed is:

1. A controlling system for a vehicle-carried internal combustion engine of a vehicle which includes a power transmitting system for transmitting driving force from said internal combustion engine to a wheel by way of a transmission and a throttle valve which is disposed in an intake air path of said internal combustion engine is capable of being actuated to open or close irrespective of an operation amount of an artificial operating number provided for operating said internal combustion engine, said controlling system comprising operation amount detecting means for detecting an operation amount of said artificial operating member, driving force transmitting condition detecting means for detecting whether or not the driving force of said internal combustion engine is transmitted from said transmission to said wheel, and controlling means for controlling, when it is detected by said driving force transmitting condition detecting means that the driving force of said internal combustion engine is not transmitted from said transmission to said wheel, said throttle valve so that the throttle opening thereof may not exceed a predetermined throttle opening greater than an idling throttle opening thereof irrespective of an operation amount of said artificial operating member detected by said operation amount detecting means, wherein said controlling means selects, when it is detected by said driving force transmitting condition detecting means that the driving force of said internal combustion engine is not transmitted from said transmission to said wheel, a smaller one of a first throttle opening which is determined from an operation amount of said artificial operating member detected by said operation amount detecting means and a second throttle opening which is determined from an operating condition of said internal combustion engine and is greater than the idling throttle opening and controls said throttle valve so that the throttle opening thereof may be equal to the thus selected throttle opening.

2. A controlling system for a vehicle-carried internal combustion engine as claimed in claim 1, wherein the second throttle opening is set in accordance with a value obtained by correcting a torque which is determined in accordance with a current condition and a permissible condition of said internal combustion engine with at least one of a temperature of said internal combustion engine and an electric load to said internal combustion engine.

3. A controlling system for a vehicle-carried internal combustion engines as claimed in claim 2, wherein an upper limit and a lower limit are set for the second throttle opening by setting an upper limit and a lower limit for a torque which is determined in accordance with a current condition and a permissible condition of said internal combustion engine.

4. A controlling system for a vehicle-carried internal combustion engine as claimed in claim 1, wherein said driving force transmitting condition detecting means is constituted as gear position detecting means for detecting a gear position of said transmission.

5. A controlling system for a vehicle-carried internal combustion engine as claimed in claim 1, wherein said driving force transmitting condition detecting means is constituted as clutch on/off detecting means for detecting an on/off condition of a clutch interposed between said internal combustion engine and said transmission.

* * * * *